United States Patent [19]

Loughry et al.

[11] Patent Number: 4,917,014

[45] Date of Patent: Apr. 17, 1990

[54] LASER IGNITION OF EXPLOSIVES

[75] Inventors: Bruce Loughry; Otho E. Ulrich, both of Ann Arbor, Mich.

[73] Assignee: KMS Fusion, Inc., Ann Arbor, Mich.

[21] Appl. No.: 342,184

[22] Filed: Apr. 24, 1989

[51] Int. Cl.[4] ..... F42C 21/00; F42C 19/00

[52] U.S. Cl. ..... 102/201

[58] Field of Search ..... 102/201

[56] References Cited

U.S. PATENT DOCUMENTS

| | | | |
|---|---|---|---|
| 3,177,651 | 4/1965 | Lawrence | 60/35.3 |
| 3,258,910 | 7/1966 | Seymour | 60/35.6 |
| 3,296,795 | 1/1967 | Nielsen | 60/39.82 |
| 3,351,016 | 11/1967 | Simpson | 102/70.2 |
| 3,362,329 | 1/1968 | Epstein | 102/70.2 |
| 3,408,937 | 11/1968 | Lewis et al. | 102/70.2 |
| 3,528,372 | 9/1970 | Lewis et al. | 102/27 |
| 3,618,526 | 11/1971 | Baker | 331/94.5 |
| 3,685,392 | 8/1972 | Platt | 42/84 |
| 3,724,383 | 4/1973 | Gallaghan | 149/92 |
| 3,812,783 | 5/1974 | Yang et al. | 102/70.2 |
| 3,911,822 | 10/1975 | Boling | 102/70.2 |
| 4,047,483 | 9/1977 | Williams | 102/70.2 |
| 4,343,242 | 8/1982 | Welk | 102/201 |
| 4,391,195 | 7/1983 | Shann | 102/201 |
| 4,455,941 | 6/1984 | Walker et al. | 102/275.8 |

FOREIGN PATENT DOCUMENTS 8807170 9/1988 World Int. Prop. O. ..... 102/201

*Primary Examiner*—Charles T. Jordan

*Attorney, Agent, or Firm*—Barnes, Kisselle, Raisch, Choate, Whittemore & Hulbert

[57] ABSTRACT

A system for laser-ignition of explosives or the like includes a laser system coupled to an optical fiber for conducting light energy to a window positioned at an end of the fiber remote from the laser system. An explosive charge is contained within an initiator housing on a side of the window remote from the adjacent fiber end. A dichroic film is positioned at the window surface adjacent to the explosive charge, and is constructed to reflect light energy within one wavelength range and transmit light energy within another wavelength range. The laser system is controlled for selectively transmitting light energy at the one wavelength range to test continuity of the laser-fiber-initiator light path as a function of reflections from the dichroic film, and at the other wavelength range to ignite the explosive charge. In one embodiment of the invention, the dichroic film takes the form of a transparent disc having the film deposited thereon. The disc is of flexible resilient construction, and is sandwiched within the housing between the window surface and the explosive charge. In other embodiments of the invention, the film is formed as a coating on and integral with one of the window surfaces or on the fiber end.

40 Claims, 2 Drawing Sheets

LASER IGNITION OF EXPLOSIVES

The present invention is directed to laser ignition of explosives such as ordnance, and more particularly to a system for transmitting ignition energy from the laser through optical fibers to one or more ignition devices or initiators.

BACKGROUND AND OBJECTS OF THE INVENTION

It has heretofore been proposed to ignite explosives by transmitting laser energy to an initiator along one or more optical fibers. One problem that arises in systems of this character involves the desired ability to test continuity and integrity of the laser-fiber-initiator light path in situ and without igniting the explosive. Another problem involves controlled sequential ignition of a plurality of explosives within a short time frame. For example, it is desirable to possess the ability to ignite multiple initiators within one millisecond. However, motor-driven mirrors and the like heretofore proposed have been characterized by switching times on the order of two milliseconds or more, and thus have not been able to obtain substantially simultaneous ignition of multiple initiators within the short time frame specified.

It is a general object of the present invention to provide an initiator and system of the described character that include facility for rapid and efficient self-test of the laser-fiber-initiator light path at will, in situ and without risk of igniting the explosive charge. Another object of the invention is to provide an initiator and system of the described character in which the continuity and integrity self-test can be rapidly performed immediately prior to and without interfering with explosive ignition.

Another object of the present invention is to provide a laser explosive ignition system of the described character in which a plurality of explosive devices may be individually ignited from a single laser source substantially simultaneously, which is to say within a prespecified short time duration such as one millisecond.

SUMMARY OF THE INVENTION

A system for laser-ignition of explosives or the like in accordance with one aspect of the present invention includes a laser coupled to optical transmission means such as an optical fiber for conducting light energy to a window positioned at an end of the fiber remote from the laser. An explosive charge is contained within a housing on a side of the window remote from the adjacent fiber end. A dichroic film is positioned at the window surface adjacent to the explosive charge, and is constructed to reflect light energy within one wavelength range and transmit light energy within another wavelength range. Light energy within the one wavelength range is selectively transmitted to test continuity of the laser-fiber-window light path as a function of reflections from the dichroic film, and light energy within the other wavelength range is selectively transmitted to ignite the explosive charge.

In one preferred embodiment of the invention, the dichroic film takes the form of a transparent disc having the film deposited thereon. The disc is sandwiched within the initiator housing between the window surface and the explosive charge. Preferably the disc is in abutting contact with the window surface and is of flexible resilient construction for conforming to the window surface. In other embodiments of the invention, the film is formed as a coating on and integral with the window surface, or as a coating on and integral with the end of the fiber.

The initiator in the preferred implementations of the invention includes facility—i.e., a lens—at the laser-remote end of the optical fiber for gathering diverging light energy emerging from the fiber and imaging such energy through the window onto the explosive charge. In one embodiment, the lens comprises a gradient index lens characterized by a non-uniform internal index of refraction that will inherently image the light energy. In another embodiment, the lens has annular reflectors on opposed surfaces for internally reflecting and imaging the energy. Preferably, in each such embodiment, the lens also forms the light-transmission window that separates the fiber end from the explosive charge. In another embodiment of the invention, the lens takes the form of a spherical ball lens.

In accordance with another aspect of the invention in which a plurality of optical fibers conduct laser energy to respective initiators and a switch selectively directs light energy from the lasing medium to the fibers, the switch is disposed within the laser cavity, and a plurality of partially transmissive reflectors or other output couplers are associated with respective ones of the optical fibers such that the laser cavity is completed and energy is extracted from the lasing medium only when the lasing medium is optically aligned by the switch with one of the couplers. In one embodiment implementing this aspect of the invention, the couplers are respectively positioned at ends of the associated fibers adjacent to the initiators, such that the fibers themselves form part of the laser cavity. In another embodiment, the couplers are positioned at the ends of the fibers remote from the associated initiators and adjacent to the lasing medium.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
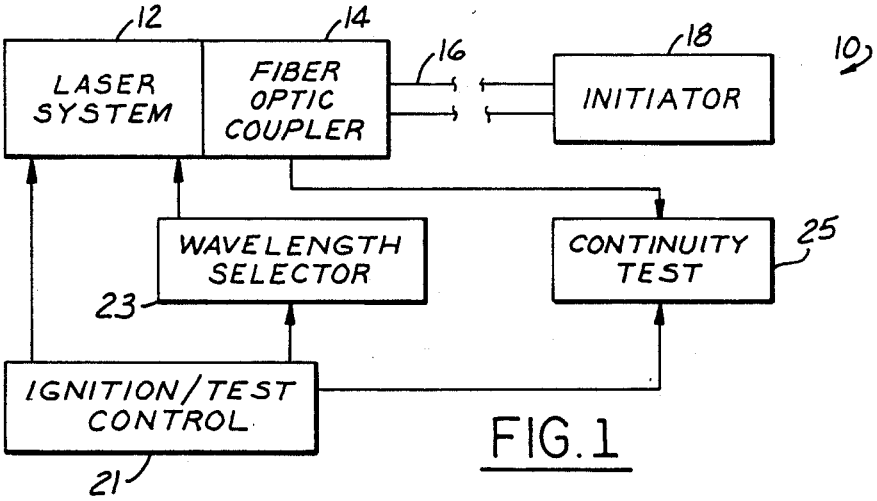
FIG. 1 is a schematic diagram of a laser explosive ignition system in accordance with one presently preferred embodiment of the invention.

FIG. 1 illustrates a laser explosive ignition system 10 in accordance with a presently preferred embodiment of the invention as comprising a laser system 12 containing lasers and other light emitters as will be described. System 12 has an output connected through a coupler 14 and an optical fiber 16 to an initiator 18. An ignition/test control 21 and a laser wavelength selector 23 are connected to laser system 12 for controlling laser output wavelength in separate test and ignition modes of operation. A continuity test system 25 receives energy reflected by initiator 18 for indicating continuity of the laser-fiber-initiator light path in a test mode of operation. Generated light energy is at relatively low power for test purposes, and at higher power for ignition.

Figure 2:
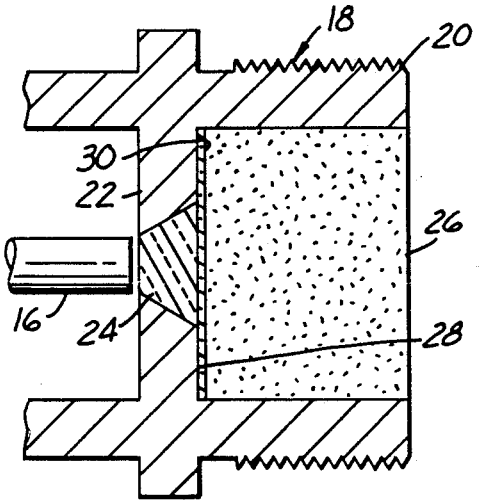
FIG. 2 is a fragmentary sectional view on an enlarged scale of an initiator in accordance with one presently preferred embodiment of the invention.

Initiator 18 in accordance with one embodiment of the invention is illustrated in FIG. 2 as comprising a generally cylindrical housing 20 having an internal lateral wall 22 in which a transparent window 24 is positioned. The laser-remote end of fiber 16 is positioned within housing 18 adjacent to one surface of window 24, while a charge 26 of suitable explosive is packed into housing 20 adjacent to the opposing window surface. A carrier 28 such as a flat circular disc is sandwiched between explosive charge 26 and the adjacent surface of window 24. Disc 28 is of optically transparent construction and has a coating or layer 30 of dichroic material adjacent to charge 26. Preferably, disc 28 is of the flexible resilient construction so as to conform readily to the surface of window 24. Mylar is a suitable material for disc 28. Dichroic coating 30 may be deposited in any conventional manner and may be of any suitable single or multiple layer dielectic or metallic material such as titanium oxide. Thickness of disc 28 may be in the range of ten to one hundred micrometers, while thickness of coating 30 may be one to ten micrometers.

In operation to test integrity and continuity of the laser-fiber-initiator light path, laser system 12 is energized within a first wavelength range, such as at a first wavelength of 1300 nm generated by a conventional light emitting diode, at which dichroic film 30 is reflective. Light energy transmitted by coupler 14 and fiber 16 to initiator 18 is thus reflected by film 30 on disc 28 back through fiber 16 to coupler 14, and a corresponding signal indicative of reflected light intensity is fed to continuity test system 25. Thus, in a test mode of operation controlled by system 21, continuity test system 25 indicates integrity of the optical system as a function of such reflected energy. Thereafter, to ignite the explosive charge, laser system 12 is controlled to transmit light energy within a second wavelength range at which dichroic film 30 is transparent, such as at a second wavelength of 800 nm generated by a conventional laser diode, such that light energy at such second wavelength is directed onto and ignites explosive charge 26 of initiator 18.

Figure 4:
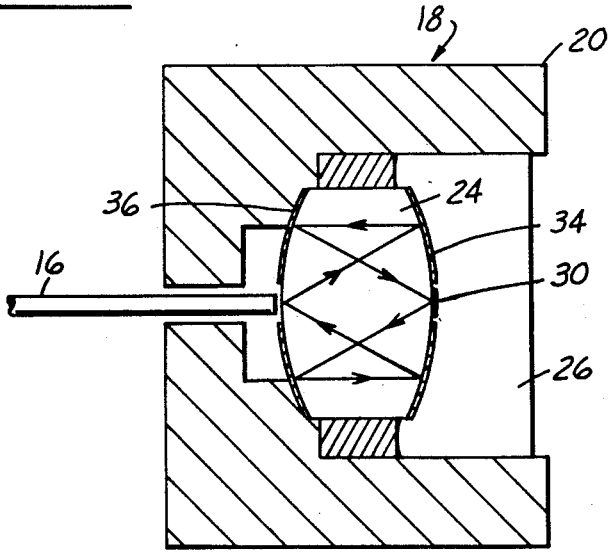
Figure 8:
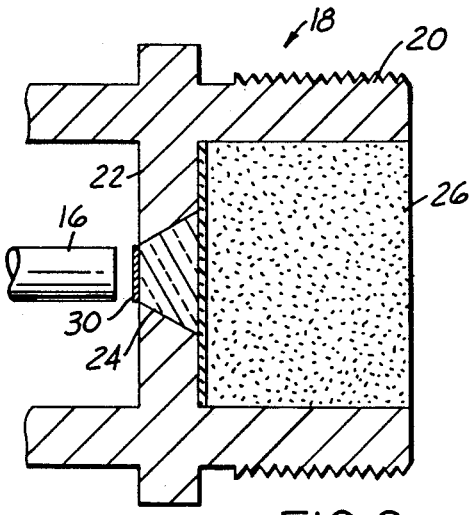
FIGS. 8 and 9 are fragmentary sectional views similar to that of FIG. 2 but illustrating modified embodiments of the initiator.
Figure 9:
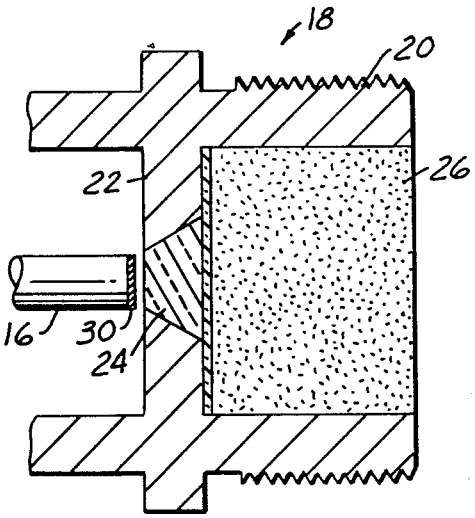

Dichroic film 30 in other embodiments of the invention may be coated directly onto window 24 prior or subsequent to assembly of window 24 to wall 22 of housing 20 (FIG. 4). However, use of a separate transparent disc 28 for carrying film 30 has the advantage of avoiding possible damage to the film when window 24 is welded in place, and is firmly held in place by the pressure of charge 26, which may be on the order of 20,000 psi. Further, film 30 may be coated onto disc 28 using any number of conventional, precise and repeatable techniques, such as vacuum deposition. Film 30 in further embodiments of the invention may be coated onto the end of fiber 16 (FIG. 9), or onto the surface of the window adjacent to the fiber end (FIG. 8). Although the film would then be less susceptible to damage in these embodiment, the laser-fiber-initiator test would not test transparency of the window itself.

Figure 3:
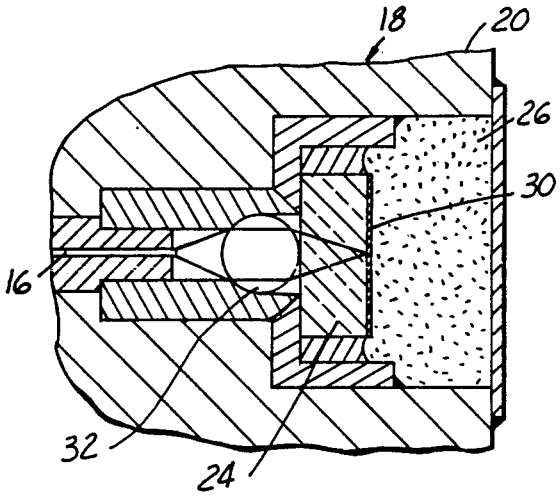
FIGS. 3–5 are sectional views similar to that of FIG. 2 and illustrating respective modified embodiments of the initiator.
Figure 5:
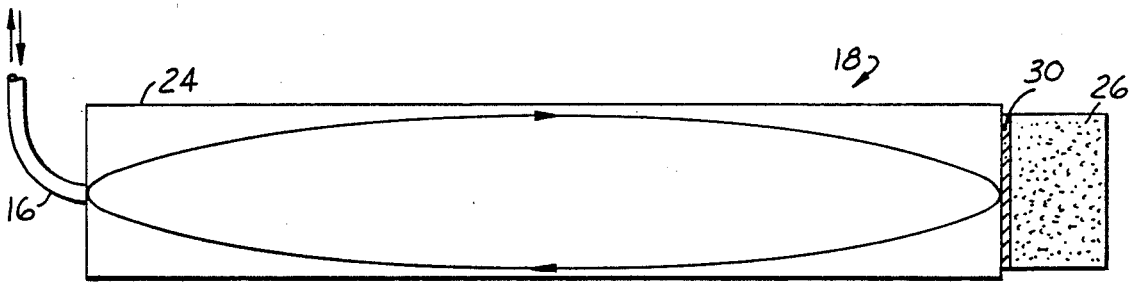

FIGS. 3–5 illustrate three modified embodiments of initiator 18 that include facility for gathering diverging light energy emerging from the end of fiber 16 and imaging such energy onto charge 26 at substantially the charge-adjacent surface of window 24. In the embodiment of FIG. 3, a spherical ball lens 32 is positioned between the end of fiber 16 and the adjacent surface of window 24. In the embodiment of FIG. 4, window 24 has axially opposed surfaces on which a pair of annular reflective layers 34, 36 are provided. Dichroic film 30 is coated on the charge-adjacent surface of window 24 within the surrounding reflective layer 34. Light energy emerging from the end of fiber 16 is internally reflected by coatings 34, 36 to film 30. In the embodiment of FIG. 5, window 24 takes the form of a gradient index lens that is characterized by a non-uniform internal index of refraction that will inherently image the light energy.

In each of the embodiments of FIGS. 3–5, light energy at the test wavelength will be reflected by dichroic film 30 back through the associated lens and optical fiber 16, while energy at the ignition wavelength will be focused through the dichroic film to ignite the explosive charge. Index of refraction for each lens or lens/window is chosen with reference to the test wavelength at which imaging is more critical. Suitable materials for use at the exemplary 1300 nm test wavelength are fused silica, borosilicate glass and saphire.

Figure 6:
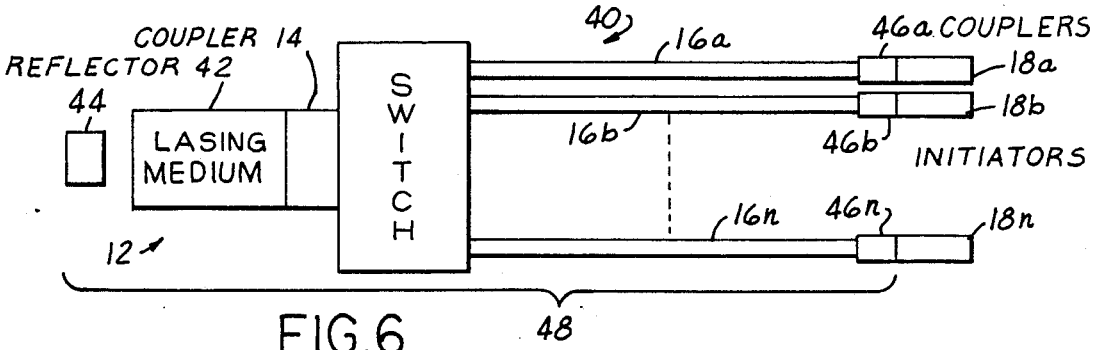
FIGS. 6 and 7 are schematic diagrams of respective modified embodiments of the system in accordance with the invention for igniting a plurality of ordnance devices.

FIG. 6 illustrates a modified system 40 for controlled sequential substantially simultaneous ignition of a plurality of initiators 18*a*–18*n*. As is conventional, laser system 12 includes a lasing medium 42 and opposed reflectors 44, 46 that define a laser cavity 48. However, in accordance with one embodiment of the invention, reflector 46 preferably takes the form of a plurality of output couplers 46*a*–46*n* each positioned between an initiator 18*a*–18*n* and the laser-remote end of the associated fiber 16*a*–16*n*. Medium 42 is coupled to fibers 16'a–16*n* through fiber optic coupler 14 and through a suitable switch mechanism 50 for directing the laser energy to optical fibers 16*a*–16*n* in sequence. Thus, each optical fiber 16*a*–16*n* forms part of the laser cavity 48 when switch 50 is aligned therewith. In the modified system 52 illustrated in FIG. 7, the couplers 46*a*–46*n* are positioned at the laser-adjacent ends of fibers 16*a*–16*n*, so that the fibers do not form part of laser cavity 48.

Figure 7:
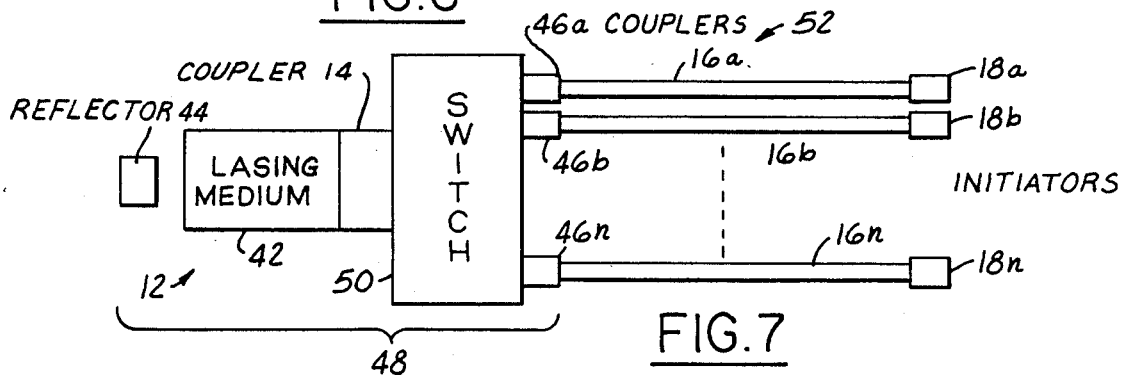

In both of the systems of FIGS. 6 and 7, energy in the lasing medium is converted into a high-intensity ignition pulse when and only when a coupler 46 is properly aligned within the laser cavity by switch 50, either through fibers 16*a*–16*n* in FIG. 6 or adjacent to switch 50 in FIG. 7. Switch 50 thus acts as a Q-switch. When such alignment takes place, the light pulse is built up very rapidly in the cavity, on the order of microseconds. The lasing medium can thus generate pulses into sequential fibers very rapidly, meeting the current requirement for substantially simultaneous ignition of ten events within one millisecond. Fast switches 50, such as electro-optical switches, can sweep the laser optical path across a line of ten or more optical fibers 16*a*–16*n* or couplers 46*a*–46*n* within one millisecond. The laser pulse then builds up rapidly when each coupler/fiber is correctly aligned, and does not depend upon accurate timing of switch 50 and laser pumping. The self-test feature described in conjunction with FIGS. 1–5 may also be embodied in the systems of FIGS. 6–7.

We claim:

1. In a system for laser-ignition of explosives that comprises a laser system, optical transmission means having a first end coupled to the laser system for receiving light energy therefrom and a second end remote from said first end, and an initiator that includes a window at said laser-remote second end of said transmission means and explosive means contained within a housing adjacent to a surface of the window remote from said second end, the improvement for testing continuity of the laser-transmission means-initiator light path without igniting said explosive means comprising:

means at said window forming a dichroic reflector for reflecting light energy within a first wavelength range and transmitting light energy within a second wavelength range, said laser system including means for selectively transmitting light energy within said first and second wavelength ranges, means coupled to said laser system for controlling the same selectively to transmit light energy within said first and second wavelength ranges, and means adjacent to said first end and responsive to light energy reflected from said reflector within said first wavelength range for indicating continuity of said laser-transmission means-initiator light path.

2. The system set forth in claim 1 wherein said reflector forming means is positioned at said window surface adjacent to said explosive means.

3. The system set forth in claim 2 wherein said reflector-forming means comprises a transparent carrier having said reflector deposited thereon as a film, said carrier being sandwiched within said housing between said window surface and said explosive mean.

4. The system set forth in claim 3 wherein said carrier is in abutting contact with said window surface.

5. The system set forth in claim 3 wherein said carrier comprises a disc of flexible resilient construction for conforming to said window surface.

6. The system set forth in claim 1 wherein said window has a second surface remote from said explosive means, and wherein said reflector-forming means comprises a film coating integral with one of said surfaces.

7. The system set forth in claim 6 wherein said reflector-forming means comprises a film coating integral with said window surface adjacent to said explosive means.

8. The system set forth in claim 1 wherein said transmission means comprises an optical fiber, and wherein said reflector-forming means comprises a film coating integral with said second end of said fiber.

9. The system set forth in claim 1 further comprising means at said second end for gathering diverging light energy emerging from said second end and imaging such energy onto said explosive means.

10. The system set forth in claim 9 wherein said gathering-and-imaging means comprises a gradient index lens.

11. The system set forth in claim 10 wherein said lens and said window are of unitary lens/window construction.

12. The system set forth in claim 9 wherein said gathering-and-imaging means comprises a lens formed integrally with said window, said lens/window having reflective means on opposed surfaces thereof for internally reflecting and imaging light energy.

13. The system set forth in claim 12 wherein said lens/window has a second surface remote from said explosive-adjacent surface and adjacent to said second end, and wherein said reflective means comprises coaxial annular reflectors at said opposed surfaces.

14. The system set forth in claim 13 wherein said annular reflectors comprise coatings integral with said opposed surfaces.

15. The system set forth in claim 14 wherein said dichroic reflector is positioned centrally of the annular reflector at said explosive-adjacent surface of said lens/-window.

16. The system set forth in claim 9 wherein said gathering-and-imaging means comprises a ball lens.

17. The system set forth in claim 1 wherein the laser system includes a laser cavity formed by a lasing medium having reflective means at each end, and wherein said transmission means is positioned within said laser cavity.

18. The system set forth in claim 1 for laser-ignition of a plurality of explosive means wherein the laser system includes a laser cavity formed by a lasing medium having reflective means at each end; and wherein the system further comprises a plurality of said optical transmission means leading to respective explosive means, and means for switching light energy from said lasing medium among said transmission means.

19. The system set forth in claim 18 wherein said optical transmission means forms part of said laser cavity.

20. An initiator comprising a housing, an optical window in one wall of said housing for admitting laser energy into said housing, explosive means within said housing adjacent to a first surface of said window, said window having a second surface remote from said explosive means, and dichroic reflective means at one of said window surfaces for reflecting light energy within one wavelength range and transmitting light energy within another wavelength range onto said explosive means.

21. The initiator set forth in claim 20 wherein said reflective means comprises means forming a dichroic film at said one surface.

22. The initiator set forth in claim 21 wherein said film-forming means is positioned at said first window surface.

23. The initiator set forth in claim 22 wherein said film-forming means comprises a transparent carrier having said film deposited thereon, said carrier being sandwiched within said housing between said first window surface and said explosive means.

24. The initiator set forth in claim 23 wherein said carrier is in abutting contact with said first window surface.

25. The initiator set forth in claim 24 wherein said carrier comprises a disc of flexible resilient construction for conforming to said first window surface.

26. The initiator set forth in claim 22 wherein said film-forming means comprises a coating integral with one of said window surfaces.

27. The initiator set forth in claim 22 wherein said coating is integral with said first window surface.

28. The initiator set forth in claim 22 wherein said coating is integral with said second window surface.

29. The initiator set forth in claim 21 further comprising an optical fiber having an end within said housing at said second window surface, and wherein said film-forming means comprises a coating on said fiber end.

30. The initiator set forth in claim 20 further comprising a lens within said housing for imaging light energy through said window onto said explosive means.

31. The initiator set forth in claim 30 wherein said lens and said window are of unitary lens/window construction.

32. The initiator set forth in claim 31 wherein said lens/window comprises a gradient index lens.

33. The initiator set forth in claim 31 further comprising reflective means on at least one surface of said lens/-window for internally imaging light energy.

34. The initiator set forth in claim 33 wherein said reflective means comprises coaxial annular concave reflectors at said first and second surfaces.

35. The initiator set forth in claim 34 wherein said annular concave reflectors comprise coatings integral with said surfaces.

36. The initiator set forth in claim 35 wherein said dichroic reflective means is positioned centrally of the reflector at said first surface of said lens/window.

37. The initiator set forth in claim 30 wherein said lens comprises a ball lens.

38. A system for laser ignition of a plurality of explosive initiators that includes: a laser having a lasing medium and opposed reflective means forming a laser cavity, a plurality of optical transmission means for conducting laser energy from said lasing medium to respective ones of said initiators, and switch means for selectively directing light energy from said medium to said transmission means in turn;

characterized in that said switch means is disposed within said laser cavity, and in that one of said reflective means comprises a plurality of output coupling means associated with respective ones of said transmission means, such that said laser cavity is completed and energy in said lasing medium is released only when said lasing medium is optically aligned by said switch means with one of said coupling means.

39. The system set forth in claim 38 wherein said plurality of output coupling means are respectively positioned at ends of said transmission means adjacent to associated said initiators, such that said transmission means forms part of said laser cavity.

40. The system set forth in claim 38 wherein said output coupling means are respectively positioned at ends of said transmission means remote from associated said initiators.

* * * * *